US006165288A

United States Patent [19]

Dwars et al.

[11] Patent Number: 6,165,288

[45] **Date of Patent: *Dec. 26, 2000**

[54] HIGHLY CORROSION AND WEAR RESISTANT CHILLED CASTING

[75] Inventors: Anja Dwars, Nuremberg; Heinz Koeper, Pegnitz; Wolfgang Prechtl, Sulzbach-Rosenberg; Joerg Schroepfer, Erlangen; Hermann Tischner, Pegnitz, all of Germany

[73] Assignee: KSB Aktienegsellschaft, Frankenthal, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,491

[22] PCT Filed: May 11, 1995

[86] PCT No.: PCT/EP95/01784

§ 371 Date: Nov. 18, 1996

§ 102(e) Date: Nov. 18, 1996

[87] PCT Pub. No.: WO95/31581

PCT Pub. Date: Nov. 23, 1995

[30] Foreign Application Priority Data

| | | | |
|---|---|---|---|
| May 17, 1994 | [DE] | Germany | 44 17 261 |
| Mar. 31, 1995 | [DE] | Germany | 195 12 044 |

[51] Int. Cl.[7] ..... C22C 38/44

[52] U.S. Cl. ..... 148/325; 148/326; 148/419; 428/659

[58] Field of Search ..... 420/52, 53, 57, 420/586.1; 148/325, 326, 327, 419; 428/659

[56] References Cited

U.S. PATENT DOCUMENTS

| | | |
|---|---|---|
| 1,211,511 | 11/1917 | Armstrong . |
| 1,245,552 | 11/1917 | Becket . |
| 1,333,151 | 3/1920 | Becket . |

(List continued on next page.)

FOREIGN PATENT DOCUMENTS

| | | | |
|---|---|---|---|
| 63734/65 | 9/1965 | Australia . | |
| 12869/66 | 10/1966 | Australia . | |
| 14453/70 | 4/1970 | Australia . | |
| 43163/72 | 6/1972 | Australia . | |
| 26703/95 | 11/1986 | Australia . | |
| 0207697 | 2/1986 | European Pat. Off. . | |
| 0 207 697 | 1/1987 | European Pat. Off. | 38/60 |
| 0 300 362 | 1/1989 | European Pat. Off. | 35/30 |
| 0300362B1 | 1/1989 | European Pat. Off. . | |
| 602812 | 6/1994 | European Pat. Off. . | |
| 731183 | 8/1932 | France . | |
| 666627 | 11/1938 | Germany . | |
| 683956 | 11/1939 | Germany . | |
| 701807 | 1/1941 | Germany . | |
| 22 30 864 | 12/1978 | Germany . | |

(List continued on next page.)

OTHER PUBLICATIONS

Korrosionsbeständigkeit hochlegierter Gusseisenwerkstoffe (Si–, Cr–, Al–legiert) Oct. 1972.

Küttner, "Contribution to the Question of the Corrosion Resistance of Iron–Chromium–Carbon Alloys", Technische Mitteilungen Krupp, Mar. 1933.

Roesch et al, "High Alloy Chromium Cast Iron as a Material in Chemical Equipment", Die Chemische Fabrik, Jun. 1933.

(List continued on next page.)

*Primary Examiner*—Deborah Yee

*Attorney, Agent, or Firm*—Evenson, McKeown, Edwards & Lenahan, P.L.L.C.

[57] ABSTRACT

A chilled casting is characterized by high corrosion resistance in aggressive media and by a wear resistance that approaches that of commercially available types of chilled casting. The disclosed chilled casting contains 36 to 46% by weight Cr, 5 to 12% weight Ni, 2 to 6% by weight Mo, up to 3% by weight Cu, up to 0.2% by weight N, up to 1.5% by weight Si, up to 1.5% by weight Mn and 1.4 to 1.9% by weight C, the remainder being Fe and impurities due to the production process. The chilled casting further contains 20 to 40% by volume austenite, 20 to 40% by volume ferrite and 20 to 40% by volume carbides having a lattice structure.

14 Claims, 2 Drawing Sheets

U.S. PATENT DOCUMENTS

Figure 1:
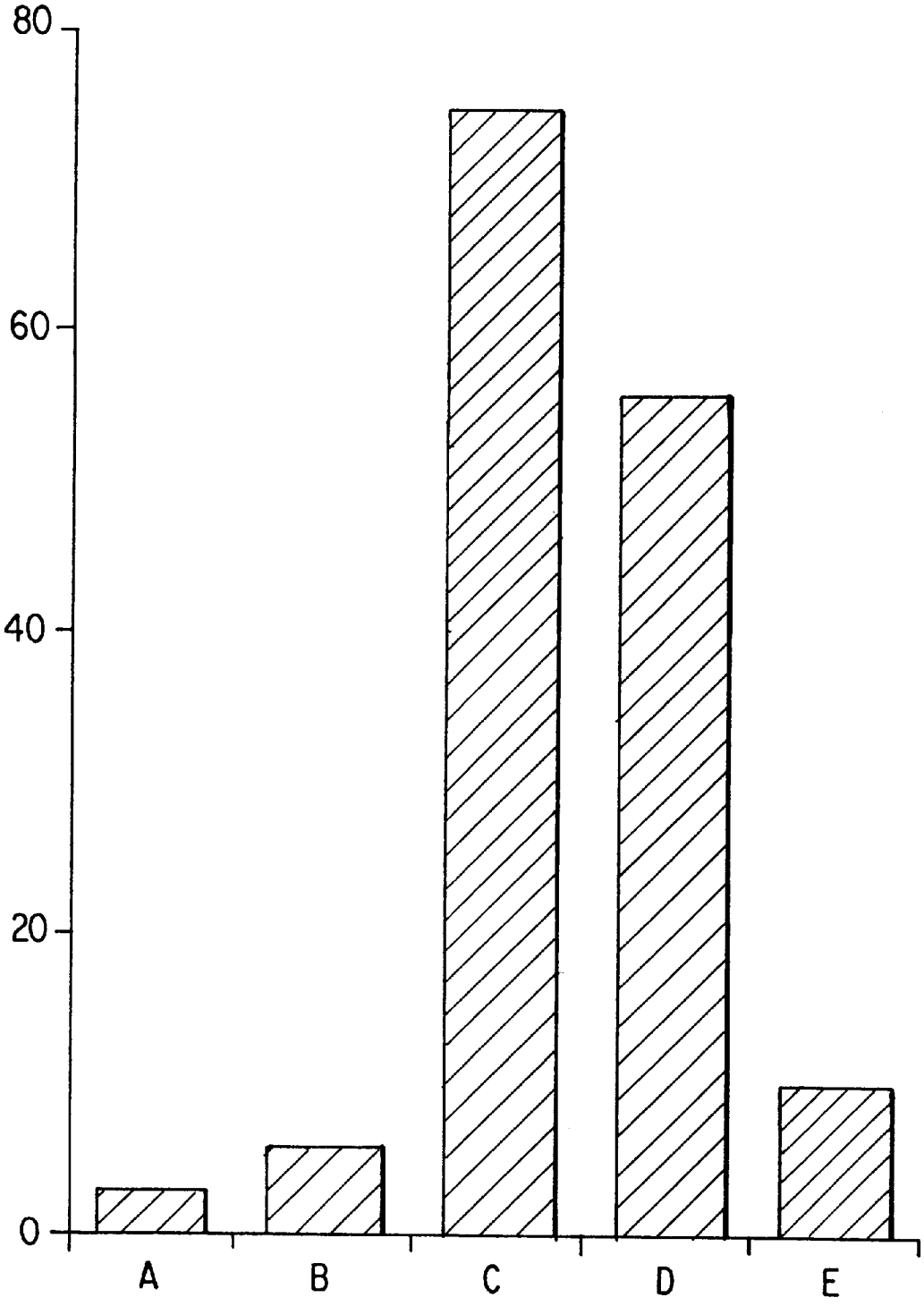

| | | | |
|---|---|---|---|
| 1,375,081 | 4/1921 | Clement . | |
| 1,389,133 | 8/1921 | Glekler . | |
| 1,454,464 | 5/1923 | Becket et al. . | |
| 1,489,429 | 4/1924 | DeLong et al. . | |
| 1,790,177 | 1/1931 | Stoody . | |
| 1,984,636 | 12/1934 | Fahrenwald . | |
| 1,990,589 | 2/1935 | Frank . | |
| 2,268,426 | 12/1941 | Schlumpf et al. | 75/126 |
| 2,311,878 | 2/1943 | Schlumpf | 76/191 |
| 2,353,688 | 7/1944 | Burgess | 148/20 |
| 2,946,676 | 7/1960 | Brennan et al. | 75/27 |
| 3,086,858 | 4/1963 | Edminster . | |
| 3,690,956 | 9/1972 | Thompson . | |
| 3,834,950 | 9/1974 | Feltz | 148/31 |
| 3,970,445 | 7/1976 | Gale et al. | 75/0.5 |
| 4,043,842 | 8/1977 | Jioret . | |
| 4,043,844 | 8/1977 | Feltz . | |
| 4,080,198 | 3/1978 | Heyer et al. . | |
| 4,487,630 | 12/1984 | Crook et al. | 75/123 |
| 4,536,232 | 8/1985 | Khandros et al. . | |
| 4,629,506 | 12/1986 | Ulrich et al. | 75/10.63 |
| 4,765,836 | 8/1988 | Hauser et al. . | |
| 4,929,288 | 5/1990 | Borges . | |
| 5,252,149 | 10/1993 | Dolman . | |
| 5,320,801 | 6/1994 | Culling . | |

FOREIGN PATENT DOCUMENTS

| | | | |
|---|---|---|---|
| 2738091 | 3/1979 | Germany . | |
| 50449 | 4/1980 | Japan . | |
| 131348 | 8/1982 | Japan | 38/52 |
| 22359 | 2/1983 | Japan | 38/18 |
| 153871 | 9/1984 | Japan | 38/50 |
| 229470 | 12/1984 | Japan | 38/56 |
| 55793 | 10/1935 | Norway . | |
| 159987 | 4/1933 | Switzerland . | |
| 382737 | 1/1973 | U.S.S.R. . | |
| 143829 | 1/1921 | United Kingdom . | |
| 220006 | 8/1924 | United Kingdom . | |
| 222158 | 9/1924 | United Kingdom . | |
| 254762 | 7/1926 | United Kingdom . | |
| 259920 | 11/1926 | United Kingdom . | |
| 267687 | 3/1927 | United Kingdom . | |
| 290924 | 6/1928 | United Kingdom . | |
| 272474 | 12/1928 | United Kingdom . | |
| 342295 | 2/1931 | United Kingdom . | |
| 344399 | 4/1931 | United Kingdom . | |
| 362375 | 11/1931 | United Kingdom . | |
| 401644 | 2/1932 | United Kingdom . | |
| 2007256 | 5/1979 | United Kingdom . | |
| WO 85/01962 | 5/1985 | WIPO . | |
| WO 91/02101 | 2/1991 | WIPO . | |

OTHER PUBLICATIONS

Roesch, "The Physical and Chemical Properties of High–Alloyed Chromium Casting" Die Giesserei, Sep. 11, 1936.

Schulte, "Properties and Application of Acid–Resistant High Chromium and Cast Chromium–Nickel–Cast Steel", Die Giesserei, Sep. 1939.

Kinzel et al, "The Alloys of Iron and Chromium", pp. 256–259, 1940.

Rabald, "The Application of Alloyed Casting in Equipment for the Chemical Industry", 1956.

Piwowarsky, "High Grade Cast Iron (Grey Iron)", pp. 637–642, 1958.

Ritter, "Corrosion Tables of Metallic Materials" pp. 8–9, 1958.

Bardes et al, Eds., "Metals Handbook Ninth Edition", pp. 76–80, pp. 114–116, 1978.

Walton et al, Eds., "Iron Castings Handbook", pp. 136–141, 1981.

Shoaee, "Corrosion Characteristics of Alloyed White Irons", Sep. 1993.

Warman Group Development, "Ultrachrome® Corrosion Resistant Alloys", Technical Bulletin, Feb. 1992.

Warman Group Development, "FGD Materials Technology", Technical Bulletin, Jan. 1994.

Walker, "A New Alloy for Phosphoric Acid Slurries", May 29, 1983.

Search Report, Sep. 18, 1995.

Tian et al, "Development of Corrosion Resistant White Irons for use in Phos–Acid Service", May 25, 1996.

Derwent Abstract of Soviet Union Patent No. 414,326, Jul. 19, 1974.

Derwent Abstract of Soviet Union Patent No. 489,808, Feb. 4, 1976.

Derwent Abstract of Australian/PCT Application No. 9,526, 703, 1996.

Abstract of Published German Patent Application No. DE 2,922,737.

Pfisterer et al., "Korrosionsbestaendiger Stahlguss", *Giesserei–Praxis*, Nr. 23–24, 1991, pp. 375–389.

Wear: *An International Journal on the Science and Technology of Friction, Lubrication and Wear*, edited by D. Scott, vol. 47, pp. 36–53 (1978).

Guenter Herbsleb and Paul Schwab, Participation of Intermetallic compounds, nitrides and carbides in AF 22 duplex steel and their influence on corrosion behavior in acids, 1983, pp. 5–9.

L.L. Shreir, Corrsion, 1963, pp. 3:111–3:117.

F. Maratray and R. Usseglic–Nanot, Factors Affecting the Structure of Chromium and Chronium–Molybdenum White Irons, 1971.

Borchers, Beitrag zum Studium der Eisenchromlegierungen unter besorderer Berucketsichtigung dr Saeurebesaendigigkeit,.

Guenter Herbsleb and Paul Schwaab, Participation of Intermatallic compounds, nitrides and carbides in AP 22 duplex steel and their influence on corrosion behavior in acids, 1983, pp. 5–9/.

L.L. Shreir, Corrison, 1963, pp. 3:111–3:117.

F. Maratray and R. Usseglio–Nanot, Factors Affecting the Structure of Chromium and Chromium–Molybdenum White Irons, 1971.

E. Houdremont and R. Wasmuht, Non–Rusting & Heat Resisting 34% Chromium Alloy Cast Irons, from Metals & Alloys, Feb. 1933, pp. 13–17.

C. Kuettner, Beitrag zur Frage der Korrosionsbeftaendigkeit von Eifen–Chrom–Kohlenftofflegierungen, fron Technische Mitteilungen Krupp, Mar. 1933, pp. 17–23.

K. Roesch and A. Clauberg, Hochlegierter Chromgubb als Werkstoff im chemischen Apparatebau, from Die Chemische Fabrik, Jul. 26, 1933, p. 30.

W. F. Furman, High–Chromium Iron Alloys for Castings, From Metals & Alloys, Oct. 1933, pp. 147–148.

G. P. Phillipos, High Chromium Cast Irons, 1934, pp. 279–285.

K. Roesch, Die physikalischen und chemischen Eigenschaften des hochlegierten Chromgusses, from Die Giesserei, Sept. 11, 1936, pp. 472–480.

J. Sissener, Foundry Work on High–Chromium Iron Castings, from Metal Progress, Oct. 1937, pp. 521–527.

F. Schulte, Eigenschaften und Verwendung von saeurebestaendigem Chromung Chrom–Nickel–Stahlguss, from Die Giesserei, Sept. 22, 1939, pp. 36–484.

A.B. Kinzel and R. Franks, The Alloys of Iron and Chromium, 1940, pp. 204–211, 228–260.

K. Roesch, Entwicklung und Stand des nichtrostenden Stahlgusses, 1950, pp. 596–607.

E. Rabald, Legierter Guss im chemischen Apparatebau, 1956.

M. G. Fontana, Corrison: A Compilation, 1957.

K. Bungardt, E. Kunze, and E. Horn, Untersuchungen ueber den Aufbau des Systems Eissen–Chrom–Kohlenstoff, Oct. 1, 1957, pp. 1–13.

E. Piwowarsky, Hochwertiges Gusseisin (Grauguss), 1958.

J. W. Boyes, Room and Elevated Temperature Mechanical Properties of 30 per cent Chromium Cast Irons, Jul. 1963, pp. 715–731.

J. W. Boyes, High–chromium cast irons for use at elevated temperature, from Iron and Steel, Mar. 1966, pp. 102–109.

Russian Article, Oct. 25, 1968, p. 72.

B. Kotula, Zeliwo stopowe Chromowe o wysokiej odpornosci na scieranie, Jun. 1969.

M.E. Garber and J.J. Cyprin, Osnowy Podbora Sostawal Struktury Iznosotojkich Otlewok Iz bielote czuguna, Liteinoe Proizvodstro, 1970, pp. 2–6.

Essential features of the production of high chromium cast irons, BICRA Broadsheet 54, 1972 H. U. Doliwa, Korrosionsbestaendigkeit hochlegierter Gubbeisenwerkstoffe (si–, Cr–, Allegiert), technische Mitteilungen, Oct. 1, 1972.

Properties of high chromium irons, BICRA Broadsheet 63, 1973.

W.D. Forgeng and W.D. Forgeng, Jr., C–Cr–Fe (Carbon–Chromium–Iron), Metals Handbook, 1973, pp. 402–404.

F. Borik, Testing for Abrasive Wear, ASTM Symposium on Selection and Use of Wear Tests for Metals, Nov. 20, 1975.

M.A. Streicher, Stainless Steels: Past, Present and Future, Stainless Steel 11 M340 Climax Molybdenum, Sept. 6, 1977.

J. Dodd, High–Chromium Cast Irons, Corrosion vol. 1, L.L. Schreir, Ed., 1976, pp. 3:111–3:117.

D. Peckner and I.M. Bernstein, Handbook of Stainless Steels, 1977, pp. 16–4–16–8.

J.J. Tsipun, M.E. Garber, S.S. Milhailovskaia, E.V. Pojkova, and G.P. Ostoikoff, New Abrasion and Corrosion Resistant White Iron, 1978, pp. 5–9.

Metals Handbook Ninth Edition, vol. 1, Properties and Selection: Stainless Steels, B.P. Bardes, Ed., Sept. 1978, pp. 76–80, 114–116.

Abrasion–Resisting High Chromium Cast Irons, J. Sakwa, Wiad. Huth., 1979, pp. 405–411.

Y. Matsubara, K. Ogi, and K. Matsuda, Eutectic Solidification of High Chromium Cast Iron –Eutectic Structures and Their Quantitative Analysis, AFS Transactions, 1979, pp. 183–196.

Iron Castings Handbook, C.F. Walton and T.J. Opar, Eds., 1981, pp. 136–141.

High–silicon cast irons –10–16% silicon, BICRA Broadsheet 219, 1982.

G. Herbsleb and P. Schwaab, Precipitation of intermetallic compounds, nitrides and carbides in AF 22 duplex steel and their influence on corrosion behavior in acids, 1983, pp. 5–7, 9.

M.A. Shoaee, Corrosion Characteristics of Alloyed White Irons, Sept. 1983, pp. 1–90.

G.Y. Shapovalova and O.I. Bashkin, Microstructure and Wear Resistance of High–Chromium Cast Irons Machined with Prior Heating, Voroshilovgrad Machine Building Institute, Oct. 1985, pp. 40–41.

R. L. Pattyn, Heat Treatment of High–Cr White Irons, AFS Transactions, 1987, pp. 161–167.

R.L. Pattyn, Bainitic Hardenability of High–Chromium White Irons, AFS Transactions, 1987, pp. 107–115.

A. Bielat, Casting Properties of High–Chromium Cats Iron, Polska Akademia Nauk, 1998.

Nichtrostender Stahlguss Technische Lieferbedingungen, May 1988.

H. Behrens, H. Tian, and R.L. Pattyn, Influence of Composition and Microstructure of White Irons on the Correlation Between Rockwell C and Equotip Hardness Measurements, AFS Transactions, 1989, pp. 87–92.

J.T.H. Pearce, B. Perry, and P.L. Blackwell, Potentiokinetic Study of the Aqueous Corrosion Behavior of High Chromium Cast Irons, Presented at International Colloquium on Cast Irons, Nov. 22, 1989.

J. Bryniarska, K. Zapalska–Nowak, and A. Gwizdz, The Course of Solification and the Chosen Properties of the Casting Alloys Containing 1.5–3.5%C and 5–40%Cr, Transactions of the Foundry Research Institute, 1990, pp. 223–251.

Warman International, Impeller life versus efficiency, Process Engineering, Sept. 1990, pp. 30–32.

Warman Group Development Technical Bulletin No. 8, Apr. 1991.

C.I. Walker, I.R. Clemitson and G.C. Bodkin, Wear Resistant Material Development for Slurry Pumps, Sept. 1993, pp. 57–59.

R. L. Pattyn, The Study of a Casting's Contribution to the Bottomline, Oct. 7, 1993, pp. 1–21.

Warman Group Developmental Technical Bulletin, No. 23, Jan. 1994.

H. Tian and G. Addie, Super Corrosion–Abrasion Resistant White Iron Alloys and Their Applications, Presented at AIChE 1996 Spring Conference in New Orleans, Jan. 1996, pp. 1–23.

H. Tian, G. Addie, and R.S. Hagler, Development of Corrosion Resistant White Irons for use in Phos–Acid Service, Annual Technical Conference of Central Florida Section of American Institute of Chemical Engineers, May 25, 1996, pp. 1–13.

HIGHLY CORROSION AND WEAR RESISTANT CHILLED CASTING

In applications involving hydroabrasive wear it is known to use carbon-containing iron-based, chromium chilled castings. A material of this kind has a carbon content of over 2.0 wt.- %. Examples of this are the materials No. 0.9630, No. 0.9635, No. 0.9645 and No. 0.9655. Since in these materials a large proportion of the chromium is used up in carbide formation, they are only corrosion-resistant to an extent corresponding approximately to unalloyed cast iron.

If now the carbon content is decreased and the chromium content increased, a slight increase of the corrosion resistance can be achieved. An example of this is the material G-X 170 CrMo 25 2. The entire group to which this material belongs has the significant disadvantage that, in chemically aggressive media, such as acidic, chloride-containing waters from flue gas desulfurizing apparatus, for example, corrosion resistance is achieved only at very high chromium contents. High chromium contents in ferritic iron-based alloys, such as the materials G-X 160 CrNiMoCu 42 2 2 2 or G-X 140 CrMnNiMoCu 41 4 2 2 1, however, adversely affect mechanical properties to a decisive extent and substantially impair castability.

Therefore, for aggressive media of the kind described above, corrosion-resistant high-grade steels are used, the wear resistance of which is slightly improved by a low carbon content (<0.5%) and a low volume proportion of carbide that results therefrom. The material 1.4464 is an example of this. The formation of chromium carbides reduces the chromium content of the base structure, whereby the corrosion resistance is correspondingly decreased. Thus any further increase of the carbon content is not advantageous.

The invention is addressed to the problem of creating a metal casting material, the wear resistance of which will correspond approximately to common commercial types of chilled castings, but which additionally will be characterized by high corrosion resistance in aggressive media.

The stated problem is solved in accordance with the invention by a chilled casting with the following composition in weight- %:

Cr=36 to 46

Ni=5 to 12

Mo=2 to 6

Cu≦3

N≦0.2

Si≦1.5

Mn≦1.5

C=1.4 to 1.9 balance Fe and impurities caused by melting;

and the following composition in volume–%:

Austenite=20 to 40

Ferrite=20 to 40

Carbides=20 to 40 and in which the carbides have a lattice-like structure.

In addition to high corrosion and wear resistance, the material according to the invention has good casting characteristics. Consequently it can be produced in conventional high-grade steel foundries. Moreover, this chilled casting has good working characteristics.

The reason for the aforementioned positive qualities is primarily a chromium content of 36 to 42 wt.- % and a carbon content of 1.4 to 1.9 wt.- %, which results in a sufficiently high volume proportion of carbides. The large increase of the chromium content decreases the chromium depletion of the matrix.

Due to the targeted addition of the austenite-former nickel in the concentration range of 5 to 12 wt.- %, it is possible to control the ratio of the ferrite and austenite phases in the matrix in a defined manner. The positive characteristics of a duplex structure in stainless steels are utilized in this case. The normally extremely great brittleness of chilled casting types with high carbon contents and a carbide lattice in a ferritic matrix is avoided by the predominant deposition of the chromium carbides in the austenitic phase. Since the austenitic phase, unlike the ferrite phase, is not embrittled by segregation of intermetallic phases or by segregation processes, the danger of fractures due to stresses between the carbides and the matrix is not as great as it is in the case of a purely ferritic matrix.

In order to achieve a structure consisting of a ferritic-austenitic matrix with embedded carbides, a heat treatment at convventional solution annealing temperatures is necessary; in this manner better workability is simultaneously achieved.

Intermetallic phases in the ferrite, which have a negative influence on the corrosion resistance and increase brittleness, are avoided by the following composition in weight- %:

Cr=38.5 to 41.5

Ni=5 to 7

Mo=2 to 3

Cu≦3

N=0.1 to 0.2

Si≦1

Mn≦1.5

C=1.4 to 1.6.

The nickel content is limited at its lower end by the amounts necessary for the formation of (secondary) austenite.

The upper limit is established by the requirement, even after air cooling of large components, to obtain a structure which consists of precipitate-free ferrite, austenite and carbides, since the formation of austenite produces a chromium enrichment of the ferrite phase and thus promotes the precipitation of σ-phase. An excessively high silicon content would have a similar undesired effect, and therefore the silicon content is limited to a maximum of 1 wt.- %. With the composition proposed above to eliminate intermetallic phases in the ferrite, an optimum combination of corrosion resistance and wear resistance is achieved.

Furthermore, through additional targeted heat treatments in correspondence to the time-temperature-transformation (TTT) curves of high-alloy steels, it becomes possible to utilize the tendency of ferrite to form precipitates (intermetallic phases) to achieve an increase in hardness and thus additionally to increase the wear resistance.

The rate of segregation of these phases is considerably increased by the following composition in weight- %:

Cr=42 to 44

Ni=8 to 10

Mo=2 to 4

Cu≦3

N≦0.1

Si=1 to 2

Mn≦1.5

C=1.4 to 1.6 and in which the ferritic content is characterized by the precipitation of intermetallic phases, so that a maximum wear resistance also can be achieved without additional heat treatment.

The molybdenum content within the limits 2 to 6 weight %, preferably 2 to 4 weight %, especially 2 to 3 weight %, is important for corrosion resistance, especially in chloride-containing, acidic media.

To reduce the risk of fracture in the casting of thick-walled pieces, the copper content is limited to 3 wt.- %. A low copper content produces better corrosion resistance in oxidizing media; therefore it is a component of common commercial high-alloy duplex steels. It is an incidental advantage of the copper content permitted in the material according to the invention, that recycled material made of commercial, high-alloy cast steel, can be used in the melting.

By varying the alloy components carbon and chromium within the limits 1.4 to 1.9 weight % for carbon and 36 to 46 for chromium, the corrosion resistance and wear resistance of the material of the invention can be adjusted to correspond to a prescribed profile of specifications.

An inhomogeneous structure with the formation of a coarse grain can be avoided in the case of high casting modules by the addition of 0.5 to 2.5 weight % vanadium as an additional alloy component. In this case, the characteristic property of vanadium to decrease the grain size only becomes sufficiently effective at contents greater than those known heretofore without negatively influencing the remaining properties.

With regard to the combination of corrosion resistance and wear resistance, the material according to the invention is decidedly superior compared to the known types of chilled castings previously utilized in applications subjected to hydroabrasive wear.

This will be explained with reference to a comparison carried out in conjunction with a working embodiment. The material according to the invention is thereby compared with four known types of chilled castings.

Figure 2:
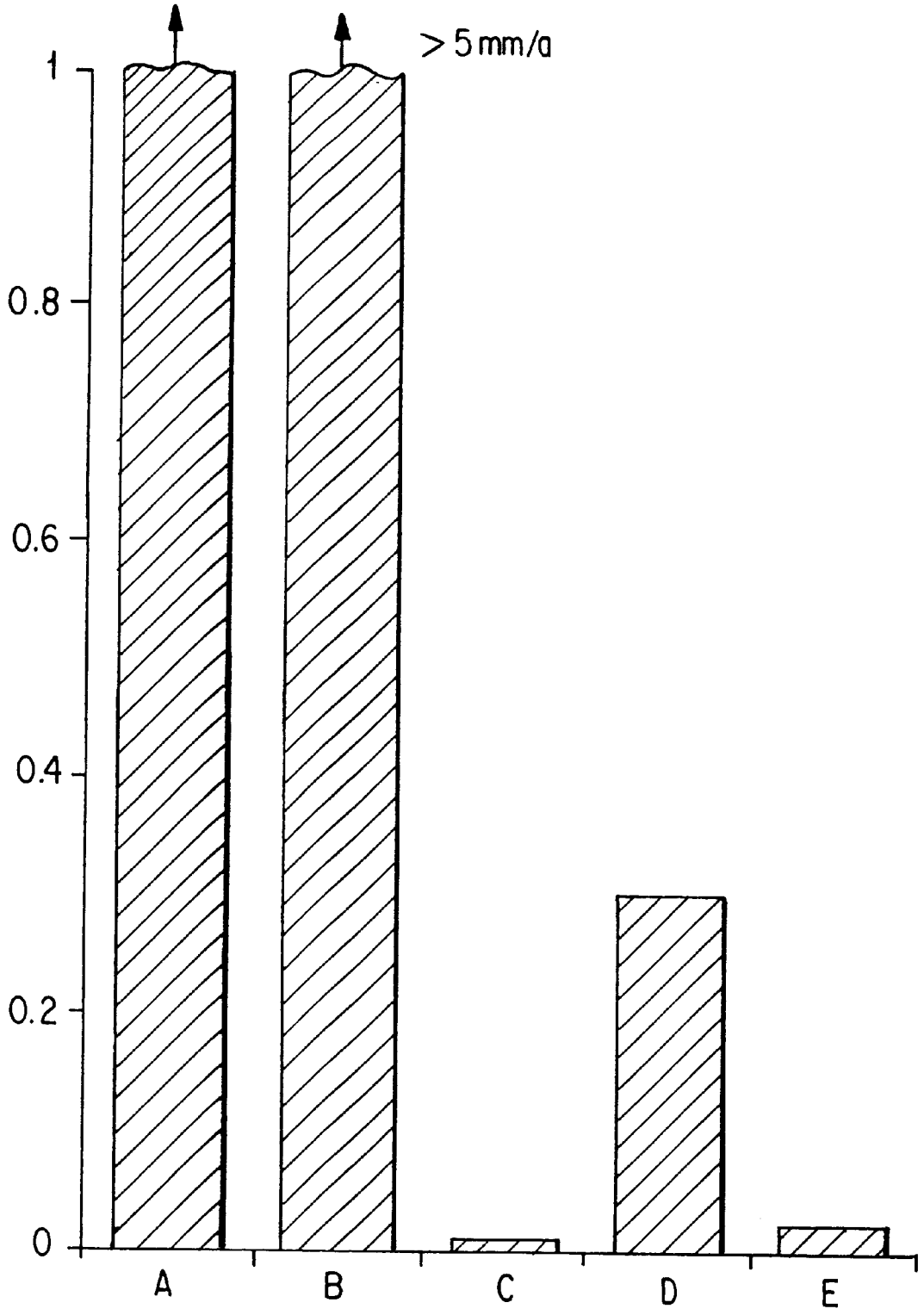

FIG. 1 shows is a diagram of the rates of abrasion of the materials by hydroabrasive wear, and FIG. 2 shows a diagram of the corrosion rates in a strongly acidic, chloride-containing medium (pH 0.5; 10 g/l of Cl-; 60° C.).

In order to determine the rates of abrasion according to FIG. 1, a model wear apparatus was utilized, in which a mixture of quartz sand and water in a mixing ratio of 1:1, with a grain size of 0.9 to 1.2 mm was used as the abrasive media. The duration of the test in each case was two hours. A rate of rotation of 3000 l/min was established. Each material sample had a diameter of 55 mm and a thickness of 5 mm.

The ordinates of the diagrams depicted in FIGS. 1 and 2 show the respective wear in millimeters per annum (mm/a). Known materials identified by the letters A to D and further described in a following Table 1 are placed on the abscissae, while the letter E identifies the material according to the invention, whose composition is indicated in the following Table 2.

TABLE 1

Known materials used for the tests.

| Identifier | Abbreviated Name |
|---|---|
| A | G-X 250 CrMo 15 3 |
| B | G-X 170 CrMo 25 2 |
| C | G-X 3 CrNiMoCu 24 6 |
| D | G-X 40 CrNiMo 27 5 |

TABLE 2

Alloy composition of the material according to the invention which was used for the tests.

| Identifier | C | Si | Mn | Cr | Ni | Mo | Cu | Fe |
|---|---|---|---|---|---|---|---|---|
| E | 1.5 | 0.7 | 0.6 | 42.1 | 8.2 | 2.5 | 1.6 | Balance |

We claim:

1. A corrosion and wear resistant chilled casting:

a) comprising the following elemental composition in weight–%:

Cr=36 to 46

Ni=5 to 12

Mo=2 to 6

Cu=0 to 3

N≦0.2

Si≦1.5

Mn≦1.5

C=1.4 to 1.9, and the balance Fe and trace impurities resulting from melting; and b) said casting containing in volume- %:

austenite=20 to 40 ferrite=20 to 40 carbides=20 to 40;

and wherein the carbides have a lattice structure.

2. A corrosion and wear resistant chilled casting according to claim 1, wherein the casting contains in weight- %:

Cr=38.5 to 41.5

Ni=5 to 7

Mo=2 to 3

Cu=0 to 3

N=0.1 to 0.2

Si≦1

Mn≦1.5

C=1.4 to 1.6.

3. A corrosion and wear resistant chilled casting according to claim 1, wherein the casting contains in weight- %:

Cr=42 to 44

Ni=8 to 10

Mo=2 to 4

Cu=0 to 3

N≦0.1

Si=1 to 2

Mn≦1.5

C=1.4 to 1.6, and wherein the ferrite contained in the casting comprises precipitated intermetallic phases.

4. A method of improving the corrosion and wear resistance of a chilled casting contacted by a flowing, solids-containing, corrosive medium, said method comprising forming the casting with the following elemental composition in weight- %:

Cr=36 to 46

Ni=5 to 12

Mo=2 to 6

Cu=0 to 3

N≦0.2

Si≦1.5

Mn≦1.5

C=1.4 to 1.9, and the balance Fe and trace impurities resulting from melting;

and with the casting containing in volume- %:

austenite=20 to 40 ferrite=20 to 40 carbides=20 to 40;

and with the carbides in the casting having a lattice structure.

5. A method according to claim 4, wherein the casting contains in weight- %:

Cr=38.5 to 41.5

Ni=5 to 7

Mo=2 to 3

Cu=0 to 3

N=0.1 to 0.2

Si≦1

Mn≦1.5

C=1.4 to 1.6.

6. A method according to claim 4, wherein the casting contains in weight- %:

Cr=42 to 44

Ni=8 to 10

Mo=2 to 4

Cu=0 to 3

N≦0.1

Si=1 to 1.5

Mn≦1.5

C=1.4 to 1.6, and wherein the ferrite contained in the casting comprises precipitated intermetallic phases.

7. A method according to claim 4, wherein said casting is a component of a pump or a fitting for conveying said medium.

8. A corrosion and wear resistant chilled casting:

a) comprising the following elemental composition in weight- %:

Cr=36 to 46

Ni=5 to 12

Mo=2 to 6

Cu=0 to 3

N≦0.2

Si≦1.5

Mn≦1.5

C=1.4 to 1.9, optionally 0.5 to 2.5 weight- % V, and the balance Fe and trace impurities resulting from melting; and b) said casting containing in volume- %:

austenite=20 to 40 ferrite=20 to 40 carbides=20 to 40;

and wherein a lattice structure is formed that consists of a ferritic-austentic matrix with embedded carbides.

9. A corrosion and wear resistant chilled casting according to claim 13, wherein the casting contains in weight- %:

Cr=38.5 to 41.5

Ni=5 to 7

Mo=2 to 3

Cu=0 to 3

N=0.1 to 0.2

Si≦1

Mn≦1.5

C=1.4 to 1.6.

10. A corrosion and wear resistant chilled casting according to claim 8, wherein the casting contains in weight- %:

Cr=42 to 44

Ni=8 to 10

Mo=2 to 4

Cu=0 to 3

N≦0.1

Si=1 to 1.5

Mn≦1.5

C=1.4 to 1.6, and wherein the ferrite contained in the casting comprises precipitated intermetallic phases.

11. A method of improving the corrosion and wear resistance of a chilled casting contacted by a flowing, solids-containing, corrosive medium, said method comprising forming the casting with the following elemental composition in weight- %:

Cr=36 to 46

Ni=5 to 12

Mo=2 to 6

Cu=0 to 3

N≦0.2

Si≦1.5

Mn≦1.5

C=1.4 to 1.9, optionally 0.5 to 2.5 weight- % V, and the balance Fe and trace impurities resulting from melting; and with the casting containing in volume- %:

austenite=20 to 40 ferrite=20 to 40 carbides=20 to 40;

and a ferritic-austenitic matrix is formed with embedded carbides.

12. A method according to claim 11, wherein the casting contains in weight- %:

Cr=38.5 to 41.5

Ni=5 to 7

Mo=2 to 3

Cu=0 to 3

N=0.1 to 0.2

Si≦1

Mn≦1.5

C=1.4 to 1.6.

13. A method according to claim 11, wherein the casting contains in weight- %:

Cr=42 to 44

Ni=8 to 10

Mo=2 to 4

Cu=0 to 3

N≦0.1

Si=1 to 1.5

Mn≦1.5

C=1.4 to 1.6, and wherein the ferrite contained in the casting comprises precipitated intermetallic phases.

14. A method according to claim 11, wherein said casting is a component of a pump or a fitting for conveying said medium.

* * * * *